United States Patent [19]

Altuchow

[11] Patent Number: 4,521,982

[45] Date of Patent: Jun. 11, 1985

[54] NOVELTY VIEWER

[76] Inventor: Nicholas Altuchow, P.O. Box 1387, Reseda, Calif. 91335

[21] Appl. No.: 607,674

[22] Filed: May 7, 1984

[51] Int. Cl.[3] ..... G09F 19/00

[52] U.S. Cl. ..... 40/407; 40/406

[58] Field of Search ..... 40/406, 407, 410; 446/267; D19/96, 97; 119/5

[56] References Cited

U.S. PATENT DOCUMENTS

| | | | |
|---|---|---|---|
| 2,361,423 | 10/1944 | Snyder | 40/406 |
| 3,059,091 | 10/1962 | Wenzel | 119/5 |
| 4,057,921 | 11/1977 | Ball | 40/406 |
| 4,085,533 | 4/1978 | Ewald | 40/406 |
| 4,395,835 | 8/1983 | Schneider | 40/406 |

OTHER PUBLICATIONS

*Washington Herald,* Apr. 4, 1941.

*Primary Examiner*—Gene Mancene
*Assistant Examiner*—Cary E. Stone
*Attorney, Agent, or Firm*—Roger A. Marrs

[57] ABSTRACT

A novelty viewer having a base supporting an enclosure which houses a graphical or simulated scene of a city or the like including a background of opaque material. The enclosure is occupied by a fluid or various fluids of different densities whereby, after shaking, at least two layers of densities result in a color differential promoting an illusion of smoggy conditions above the graphic or simulated scene. The density differential of the layers may be effected by different densities of liquid, by different size and weight of particles or by structurally separated liquid chambers.

1 Claim, 5 Drawing Figures

FIG. 1
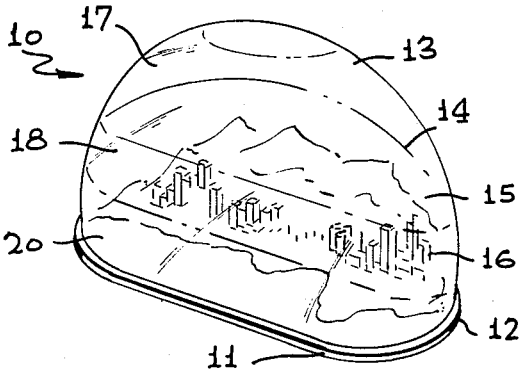
FIG. 2
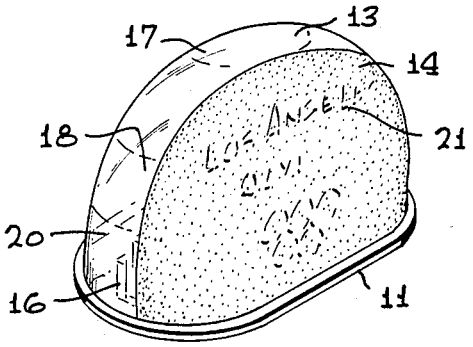
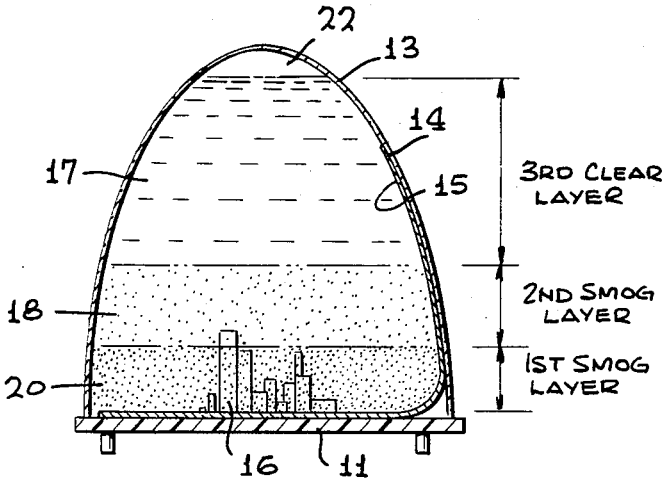
FIG. 3
FIG. 5
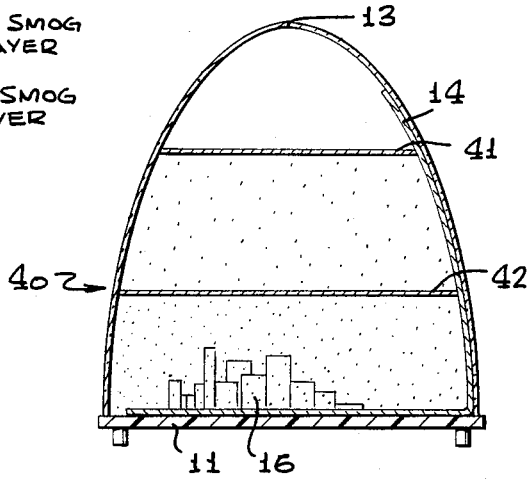
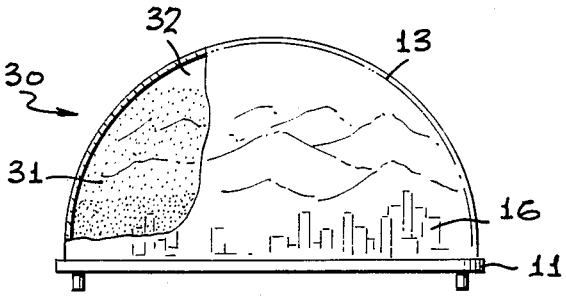
FIG. 4

NOVELTY VIEWER

BACKGROUND OF THE INVENTION

1. Field of the Invention

The present invention relates to novelty articles and, more particularly, to a novel viewer having multiple layers of liquids and/or particles of different densities wherein several layers of different densities are provided after shaking and settling thereof so as to provide a decorative scene.

2. Brief Description of the Prior Art

In the past, novelty viewers have been provided which enclose a multiplicity of particles in a liquid which, when shaken, cause the particles to disperse and momentarily become suspended in the liquid so as to augment a scene or graphic presentation at the rear of the enclosure. In one instance, the particles represent snow while the graphic scene includes a statue associated with winter and the graphics also include winter scenery. As the suspended particles settle to the base of the enclosure, the scene is unclouded and therefore changes accordingly. The enclosure is transparent so that the entire view and scene is available to an observer.

Such a prior novelty viewer is successful for presenting an interesting picture or view; however, no attempts have been made to stratify the particles into layers so as to provide an illusion of different sky or climatic or atmospheric conditions. For example, it is customary in certain cities to experience a climatic condition known as smog wherein a variety of layers are noticed by an observer due to the density of the layer depending on the smog condition.

Therefore, a need has existed to provide a novelty item such as a viewer which will readily present to an observer a simulated smog condition or at least the illusion of a smog condition in conjunction with the graphic background of a city wherein the smog condition is represented by a plurality of layers of different densities simulating smog layers.

SUMMARY OF THE INVENTION

Accordingly, the above problems and difficulties are obviated by the present invention which provides a novel viewer having a base supporting an enclosure of transparent material containing a quantity of liquid surrounding a graphic showing of a city. The graphic showing is included as graphic characters set forth on a display card mounted within the enclosure in a substantially vertical position and a statue or structural presentation of a city carried on the base immediately adjacent to the vertically displayed subject matter. In one form of the invention, the plurality of layers is provided by including within the enclosure a variety of liquids of different densities so that each respective density would represent a given layer. Another form of the invention resides in the provision of a plurality of particles of different size and weight within the liquid so as to be suspended in layers within the liquid while another form resides in the provision of separating members establishing multiple layers of liquid within the enclosure.

Therefore, it is among the primary objects of the present invention to provide a novel viewer which will present an illusion to an observer of a plurality of layers of different density composition.

Another object of the present invention is to provide a novel viewer wherein a plurality of different layers of varying density are disposed in conjunction with graphic subject matter and other indicia so as to establish a climatic condition surrounding a city or area.

Yet another object of the present invention is to provide a novel viewer for presenting the illusion of smog surrounding the city by employing a variety of layers established by liquids of different densities, by separate layers of liquid within established and defined chambers or by a plurality of particles of different size and weight.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view showing the novel viewer of the present invention employing liquids of different densities for establishing the required illusion of smog layers;

FIG. 2 is a rear perspective view of the viewer shown in FIG. 1 illustrating advertising, message or other indicia displayed thereon;

FIG. 3 is a longitudinal cross-sectional view of the novel viewer shown in FIGS. 1 and 2 incorporating the present invention;

FIG. 4 is a front elevational view, partially broken away, of another embodiment of the present invention employing particles of different size and weight suspended in a liquid to give the illusion of smog layers; and FIG. 5 is a front elevational view, partially broken away, of still another embodiment of the present invention showing the illusion of smog layers defined by chambers separated by solid separators.

DESCRIPTION OF THE PREFERRED EMBODIMENT

Referring to FIG. 1, the novel viewer of the present invention is shown in the general direction of arrow 10 which includes an elongated base 11 having rounded ends such as end 12 on which an enclosure 13 is carried. If desired, the base 11 may comprise the bottom of the enclosure or container 13; however, it is to be understood that the body of the container or enclosure 13 is composed of a transparent material such as glass or plastic or plastic-like material. Within the interior chamber of the enclosure 13, there is provided a backdrop sheet 14 having a scene or graphic subject matter displayed thereon and represented in general by the numeral 15. Immediately ahead of the scenic or graphic subject matter 15, there is provided a relief or statue representation of additional subject matter connected with the scene 15 which in the present instance is represented by the buildings of a city and is generally indicated by the numeral 16.

The interior of the enclosure 13 is occupied by fluids of at least three different densities. The liquids or fluids cannot be combined with each other and, when shaken, the layers will mix while the liquids are in their dynamic state; however, when the liquids settle, the three densities of liquid will provide three separate layers. The uppermost layer is indicated in general by the numeral 17 and resides between the uppermost two oval broken lines. The second layer is indicated by numeral 18 and resides between the lowermost two oval broken lines and the third layer is the bottom layer as indicated by numeral 20 which is disposed between the lower oval broken line and the base 11. Although the liquids or fluids of different density will provide a noticeable difference in color due to their differences in density, it is preferred that each of the layers or fluids disposed in each layer include a color or pigment. The lightest density layer 17 may be colorless or clear while the middle layer 18 is intended to be the darkest having a definite brown or brownish cast. The lower layer 20 can either be substantially clear or colorless, but also may have a slightly brownish cast which is of a lighter color than the color in the layer 18. The overall appearance of the viewer will be a city having a mountain background with a smog layer represented by the middle layer 18. In other words, when the device is shaken, the liquids will move within the overall interior of the enclosure until, as settling occurs, the middle layer will be the brownish layer in color of all of the layers and will be across the skyline of the city representing a smog layer.

Referring now to FIG. 2, it can be seen that the backdrop sheet 14 includes a display area represented in general by the numeral 21 on which selected indicia, graphic characters or other graphic subject matter can be displayed. The provision for such a display area adds to the novelty of the item and further ties in with the subject matter displayed by the graphics 15 and the relief or statuary 16.

Referring now in detail to FIG. 3, it can be seen that the three layers represented by numerals 17, 18 and 20 are disposed on top of one another due to the density of the liquids or fluids contained within the enclosure after settlement and non movement of the viewer. A small air pocket 22 is included and the sheet 14 is substantially vertical against the inside wall or surface of the enclosure 13 while a lower portion of the sheet curves against the base 11 and continues forwardly to the opposite side of the enclosure 13. Construction in this manner provides that the graphic subject matter 15 can be placed onto the sheet along with the relief or statuary subject matter 16 as a single unit or unitary construction. The sheet is next glued or otherwise attached respectively to the bottom 11 and/or the inside wall of enclosure 13. As previously stated, the first, second and third layers are of different liquid densities and include color pigments so that at least layer 18 is substantially darker in color from layers 17 and 20. If desired, layer 20 can be made darker than layer 17; however, layer 20 is not to be as dark layer 18.

Referring now in detail to FIG. 4, another embodiment of the present invention is illustrated in the general direction of arrow 30 which is substantially similar to the embodiment shown in FIGS. 1–3 inclusive with the exception that a liquid of equal density is enclosed within the enclosure 13 and a plurality of particles of different size and weight are suspended in the liquid. The particles are indicated in general by the multiplicity of dots forming a cloud and broadly indicated by numeral 31. The liquid is indicated by numeral 32 in which the particles are suspended. After shaking, the particles of greatest density and weight will be suspended at a lower level in the liquid than the particles which are of smaller size and lighter weight. Therefore, a graduated density of particles will be suspended in the liquid 32 so that a greater density will surround or be about the city 16 forming a first layer while other particles of smaller size and lesser weight will form a second layer immediately above the first layer and particles of even smaller size and lesser weight will reside adjacent the top portion of the container 13 representing a third layer. A differential in color is provided between the various layers by employing colored particles or by including substantially more particles in certain layers. For example, the particles of medium density and medium weight representing the second layer can be colored a light brown while the other particles are of neutral or lighter color or these particles may be increased in number so that their density represents a darker layer than the adjacent layers.

Referring now to FIG. 5, still another embodiment of the present invention is illustrated in the general direction of arrow 40 which includes the interior of enclosure 13 being divided into three separate chambers by separator members 41 and 42. The members extend across the width of the enclosure 13 and is attached thereto and to the sheet 14 by any suitable means such as adhesive or the like. The respective chambers separated by the separators 41 and 42 contain a liquid and the liquid in each of the respective chambers is tinted with a coloring so as to provide the required color differential between layers. Preferably, the middle chamber defined between the opposing surfaces of separators 41 and 42 may be the darkest layer while the liquid between the separator 42 and the base 11 may be of a lighter color and the liquid in the chamber on top of separator 41 may be a clear liquid.

In view of the foregoing, it can be seen that a novelty item is provided which, when initially shaken, will provide a clouded atmosphere before a civic scene including the buildings 16 and graphic material on the surface of sheet 14. As motion of the article stops and liquid settles, different colored layers will appear so that the middle layer or area immediately adjacent to the buildings 16 will be of a darker color or cast than the liquid above or below the middle layer. Thus, the appearance of a smog layer over a city is represented. The indicia or printed subject matter on the display area or space 21 will tie in a theme message with the scenery depicted on the opposite side of the sheet 14.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A novelty viewer comprising:

an elongated base having rounded ends;

an enclosure carried on said base having a fluid content;

a sheet disposed against a portion of the inner surface of said enclosure;

an animated structure of a city disposed on said base within said enclosure and immersed in said fluid;

said fluid adapted to visually appear in at least three layers within said enclosure having the lowermost layer denser in color than the upper layers;

said sheet carries graphic indicia or illustrations characterized as a background for said animated city structure;

a plurality of particles of different size and weight suspended in said fluid;

selected particles of similar size and weight constituting and defining said three layers with particles of greatest density and weight defining the lowermost level.

* * * * *